US005480498A

United States Patent [19]

Beaudoin et al.

[11] Patent Number: 5,480,498

[45] Date of Patent: Jan. 2, 1996

[54] METHOD OF MAKING ALUMINUM SHEET PRODUCT AND PRODUCT THEREFROM

[75] Inventors: Armand J. Beaudoin, Richmond; J. Daniel Bryant; Alan J. Janousek, both of Midlothian; Rajeev G. Kamat, Richmond; H. Edwin Oliver, Richmond; Robert M. Ramage, Richmond, all of Va.

[73] Assignee: Reynolds Metals Company, Richmond, Va.

[21] Appl. No.: 246,653

[22] Filed: May 20, 1994

[51] Int. Cl.[6] ..... C22F 1/04

[52] U.S. Cl. ..... 148/549; 148/552; 148/691; 148/692; 148/693; 148/696; 148/697; 148/698; 148/415; 148/437

[58] Field of Search ..... 148/549, 552, 148/691, 692, 693, 696, 697, 698, 415, 437

[56] References Cited

U.S. PATENT DOCUMENTS

| | | | |
|---|---|---|---|
| 2,070,833 | 2/1937 | Keller et al. | 148/700 |
| 3,945,861 | 3/1976 | Anderson et al. | 148/690 |
| 4,000,007 | 12/1976 | Develay et al. | 148/523 |
| 4,082,578 | 4/1978 | Evancho et al. | 148/535 |
| 4,151,013 | 4/1979 | Thompson et al. | 148/439 |
| 4,269,632 | 5/1981 | Robertson et al. | 148/550 |
| 4,424,084 | 1/1984 | Chisholm | 148/417 |
| 4,486,244 | 12/1984 | Ward et al. | 420/902 |
| 4,528,042 | 7/1985 | Ward et al. | 420/902 |
| 4,614,552 | 9/1986 | Fortin et al. | 148/417 |
| 4,626,294 | 12/1986 | Sanders, Jr. | 148/439 |
| 4,699,673 | 10/1987 | Kobayashi et al. | 148/693 |
| 4,784,921 | 11/1988 | Hyland et al. | 148/417 |
| 4,808,247 | 2/1989 | Kamatsubara et al. | 148/415 |
| 4,897,124 | 1/1990 | Matsuo et al. | 148/415 |
| 4,909,861 | 3/1990 | Muraoka et al. | 148/439 |
| 4,921,548 | 5/1990 | Cho | 148/415 |
| 4,946,517 | 8/1990 | Cho | 148/415 |

(List continued on next page.)

FOREIGN PATENT DOCUMENTS

| | | |
|---|---|---|
| 905616 | 4/1945 | France . |
| 768097 | 2/1957 | United Kingdom . |

OTHER PUBLICATIONS

Recent Studies into the Mechanism of Ridging in Ferritic Stainless Steels, Hung-Chi Chao, Metallurgical Transactions—vol. 4, Apr. 1973, pp. 1183–1186.

Effects of Grain Anisotropy on Limit Strains in Biazial Stretching: Part II, Sheets of Cubic Metals and Alloys with Well-Developed Preferred Orientations, D. V. Wilson, W. T. Roberts, and P. M. B. Rodrigues, Metallurgical Transactions A, vol. 12A, Sep. 1981, pp. 1603–1611.

Texture Inhomogeneity and Limit Strains in Aluminum Sheet, P. S. Bate, IRC in Material for High Performance Applications, The University of Birmingham, Scripta Metallurgica et Materialia, vol. 27, pp. 515–520, 1992.

On the Effect of Copper, Magnesium and Silicon Content on the Properties of Al–Cu–Mg Alloys, Lilienthal Company for Aviation Research on Feb. 14, 1938 in Berlin (trans.).

*Primary Examiner*—David A. Simmons
*Assistant Examiner*—Robert R. Koehler
*Attorney, Agent, or Firm*—Alan M. Biddison

[57] ABSTRACT

A method of producing aluminum alloy sheet product includes casting a slab, homogenizing the cast slab, and hot rolling the homogenized slab to provide an intermediate gauge product. The temperature and other operating parameters of the hot rolling process are controlled so that the temperature of the intermediate gauge product exiting the hot rolling step is between about 500° F. and 650° F. Preferably, the temperature does not exceed 575° F. The intermediate gauge product is then subjected to a cold reduction of 45% to 70%, annealed, and cold rolled to final gauge. The combination of controlling the hot rolling to provide a desired exit temperature of the intermediate gauge product and annealing prior to cold rolling to final gauge minimizes or eliminates the appearance of ridging or roping line defects in the aluminum sheet product when subjected to further straining in a forming or stamping operation. An improved aluminum alloy sheet product is produced having a superior surface finish for use in automotive components such as hoods or deck lids.

18 Claims, 1 Drawing Sheet

U.S. PATENT DOCUMENTS

| | | | |
|---|---|---|---|
| 5,019,188 | 5/1991 | Hasenclever | 420/535 |
| 5,021,106 | 6/1991 | Iwai et al. | 148/437 |
| 5,062,901 | 11/1991 | Tanaka et al. | 148/417 |
| 5,080,728 | 1/1992 | Hasenclever | 148/437 |
| 5,098,490 | 3/1992 | Huu | 148/415 |
| 5,104,465 | 4/1992 | McAuliffe et al. | 148/439 |
| 5,106,429 | 4/1992 | McAuliffe et al. | 148/437 |
| 5,110,545 | 5/1992 | McAuliffe et al. | 420/534 |
| 5,116,428 | 5/1992 | Hasenclever | 148/438 |
| 5,122,196 | 6/1992 | Fernandez | 148/552 |
| 5,137,686 | 8/1992 | Rioja et al. | 420/528 |
| 5,192,378 | 3/1993 | Doherty et al. | 148/691 |
| 5,194,101 | 3/1993 | Worcester et al. | 148/671 |
| 5,213,639 | 5/1993 | Colvin et al. | 148/693 |
| 5,223,055 | 6/1993 | Charquet et al. | 148/672 |
| 5,240,522 | 8/1993 | Tanaka et al. | 148/693 |

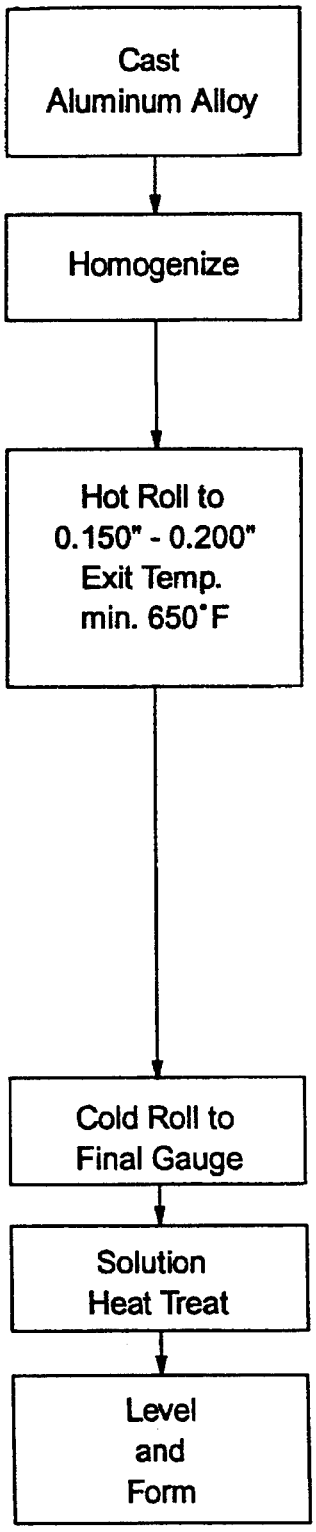
Figure 1. (Prior Art Practice.)
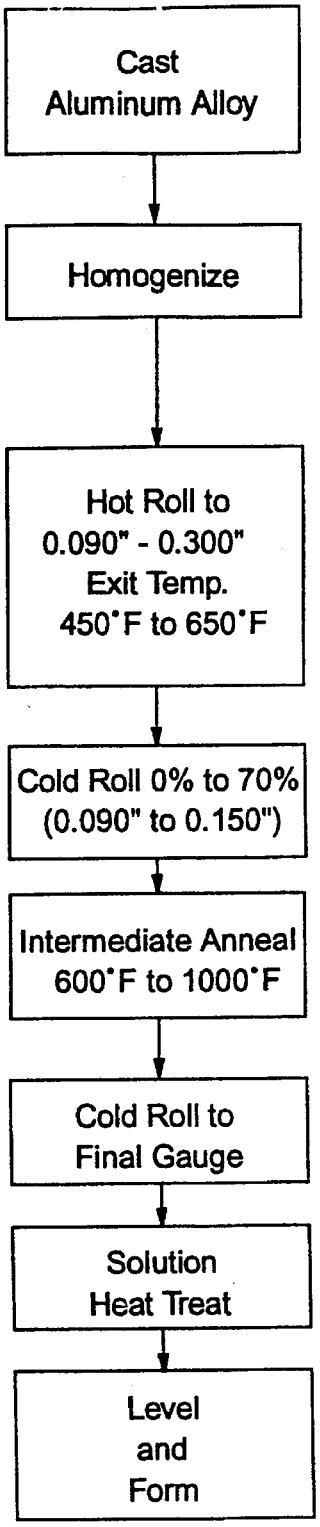
Figure 2.

METHOD OF MAKING ALUMINUM SHEET PRODUCT AND PRODUCT THEREFROM

FIELD OF THE INVENTION

The present invention is directed to a method of making aluminum sheet product and products therefrom and, in particular, to a method of controlling hot rolling exit temperatures during automotive sheet processing to minimize or eliminate certain surface defects, referred to as ridging, in the final gauge product.

BACKGROUND ART

In the automotive industry, the use of aluminum alloys for automotive applications is increasing due to their desirable combination of properties such as low density, high strength, corrosion resistance, and formability.

Typically, automotive body sheet products are approximately 0.040" in thickness and include 2000 and 6000 series aluminum alloys. Preferred 2000 series aluminum alloys include, but are not limited to, AA2008, AA2010, and AA2036. Preferred 6000 series aluminum alloys include, but are not limited to, AA6009, AA6010, AA6016, and AA6111. Outer body panel applications require high strength, typically to improve dent resistance, and superior surface appearance, to ensure that no discontinuities are visible after paint has been applied. Inner body panel applications do not require the strength levels or surface appearance necessary for outer body panel applications; however, formability is a critical concern because of the complex nature of most inner body panel designs.

With reference to FIG. 1, a typical prior art processing sequence is depicted for making aluminum sheet. Ingots of the aluminum alloy are cast, homogenized and hot rolled to a desired gauge, such as approximately 0.18041. Typically, the homogenized ingot enters the hot rolling step at a temperature of approximately 850° F. to 1000° F. and exits at temperatures generally greater than 650° F. The hot rolled material is then cold rolled to final gauge, solution heat treated, leveled, and formed for its desired end use. U.S. Pat. No. 4,614,552, entitled ALUMINUM ALLOY SHEET PRODUCT, the contents of which are herein incorporated by reference, describes conventional prior art practice for producing AA6111 alloys.

One drawback associated with the use of aluminum alloys for automotive components is the presence of objectionable and/or deleterious surface defects referred to as ridging, roping, or paint brush lines, which appear on the surface of stamped or formed aluminum sheet components. The ridging lines are present on the surface of the automotive component as a series of closely spaced lines in the rolling direction. Typically, the ridging lines are approximately 0.2 microns high and are spaced less than approximately 1 mm apart. The ridging or roping lines appear in the rolling direction only upon application of sufficient transverse strain, as that occurring in typical stamping or forming operations.

This ridging defect is of sufficient severity to be visible in the automotive component after painting. Consequently, the finished surface appearance of these aluminum alloys is objectionable and not suitable for exterior automotive applications. This ridging defect may also serve as a strain concentration site during forming, thus limiting formability.

In view of the problems with automotive components processed using aluminum sheet made with prior art practices, a need has developed to eliminate the ridging line defect in aluminum alloy sheet products. Elimination of this defect should encourage increased application of aluminum alloys.

In response to the preceding, the present invention provides a method of making aluminum alloy sheet product, especially for automotive use, which minimizes or eliminates the occurrence of ridging lines. The inventive method produces an aluminum alloy sheet product which can be stamped or formed and painted for automotive use without an objectionable surface appearance having defects, such as ridging or roping lines.

SUMMARY OF THE INVENTION

Accordingly, a first object of the present invention is to provide a method of making aluminum alloy sheet product which eliminates or minimizes ridging lines in the finished product.

Another objective of the present invention is to provide a method of making aluminum alloy sheet product which also improves the formability of the sheet for subsequent forming and/or stamping.

Other objects and advantages of the present invention will become apparent as a description thereof proceeds.

In satisfaction of the foregoing objects and advantages, the present invention is an improvement over the prior art method of producing aluminum alloy sheet product, especially for automotive use, wherein the aluminum alloy is cast, homogenized, hot rolled to an intermediate gauge, cold rolled to final gauge, and solution heat treated for subsequent automotive component use. It should be appreciated that reference to the term "automotive" is intended to encompass similar applications, such as for light truck component use.

According to the invention, the temperature of the hot rolling of the aluminum alloy intermediate product and other process parameters are controlled so that the temperature of the intermediate product exiting the rolling mill is less than about 600° F. In one embodiment, it is preferred that the temperature of the intermediate product not exceed 575° F. The hot rolled product is then cold rolled to final gauge, with the application of an intermediate anneal following cold rolling of the hot line product between 0% and 70% of the total cold rolling reduction. The intermediate annealing temperature ranges between about 600° F. and about 1,000° F.

In the embodiment wherein the sheet is annealed after 0% cold work, a preferred annealing temperature ranges between 700° F. and 800° F. for about two hours. In the alternative embodiment wherein the intermediate gauge sheet is annealed after about 45% to 70% cold work, a preferred annealing temperature range is between 600° F. and 700° F. for about two hours.

Preferably, the aluminum alloy used in the inventive process is either an AA6000 series or an AA2000 series alloy, more preferably, an AA6111 type alloy. However, any aluminum alloy adaptable for sheet use can be utilized in the invention.

The inventive method produces an intermediate product in the form of a hot rolled band which can be subsequently annealed and cold rolled to a final gauge sheet product devoid of or having a minimum of ridging or roping lines on the surface thereof. The invention also provides a final cold rolled gauge sheet product which can be solution heat treated, leveled, and formed to provide an automotive component.

BRIEF DESCRIPTION OF THE DRAWINGS

Reference is now made to the accompanying drawings wherein:

FIG. 1 is a schematic drawing of a prior art process for making aluminum alloy sheet; and FIG. 2 is a schematic diagram depicting the inventive method for producing aluminum alloy sheet.

DESCRIPTION OF THE PREFERRED EMBODIMENTS

Producing aluminum alloy sheet according to the present invention eliminates or minimizes the ridging defect known as ridging, roping, or paint brush lines in aluminum sheet product, in particular, automotive sheet.

According to the invention, ridging lines which present an objectionable surface appearance, especially in automotive applications, are eliminated or minimized at final gauge by controlling the hot rolling operation of a cast and homogenized ingot or slab so that the temperature of the aluminum alloy sheet exiting hot rolling falls within a desired range. The hot rolled aluminum sheet is then annealed in conjunction with cold rolling to final gauge. The final gauge aluminum sheet product, when strained, does not exhibit an objectionable amount of ridging, roping, or paint brush lines typically found in prior art aluminum sheet.

With reference now to FIG. 2, an aluminum alloy, preferably an AA2000 or AA6000 series alloy, is cast and homogenized according to conventional practice. Typically, the alloys are cast as a slab or ingot, scalped, and homogenized at high temperature for an extended period of time, for example, 950° F. to 1050° F. for approximately 2 to 24 hours.

Since the casting and homogenizing steps are conventional for these types of alloys, further discussion in conjunction with the invention is not deemed necessary.

After the homogenization step, the cast aluminum alloy slab or ingot is hot rolled to an intermediate gauge ranging between about 0.090 inches and 0.300 inches.

During hot rolling, temperatures and other operating parameters are controlled so that the temperature of the aluminum alloy hot rolled intermediate product upon exit from the hot rolling mill is between about 450° F. and 650° F., preferably between about 500° F. and 600° F. More preferably, the temperature does not exceed 575° F. Alternatively, the temperature of the intermediate gauge product is controlled between 550° and 600° F. As will be described below, controlling the exit temperature of the hot rolling step is believed to provide a microstructure which, when further processed, does not form the ridging line defect at final gauge.

Controlling the exit temperature of the hot rolled aluminum alloy intermediate product can be done in any conventional manner, such as through control of the hot mill cooling lubricant, rolling speed, or time delays between the various steps on a typical hot mill. The temperature of the hot rolled intermediate product can then be monitored using known techniques, such as contact thermocouples or optical pyrometry. The monitored hot mill exit temperature can be used in a feedback control manner in conjunction with cooling the slabs or controlling temperatures during hot rolling using cooling lubricants, mill speeds, or the like as described above. That is the mill exit temperature can dictate adjustment in the rolling operation to maintain the exit temperature within the specified range.

In one embodiment, the cast aluminum alloy is hot rolled to an intermediate gauge of less than 0.180", with a preferred thickness of 0.130" and a preferred exit temperature of about 500° F. to 575° F. The hot rolling step can be performed using any conventional hot rolling mill capable of reducing the cast aluminum alloy material to the desired intermediate gauge.

Following hot rolling, the hot rolled intermediate product, which may be sheet or plate, is subject to an intermediate anneal, following 0% cold work, at a predetermined temperature and time prior to cold rolling to final gauge. Preferred temperatures and times range from 700° F. to 900° F. for up to 18 hours.

An alternative embodiment includes hot rolling the cast aluminum alloy to an intermediate gauge of 0.180 inches to 0.300 inches at the exit temperature less than 650° F. The hot rolled intermediate gauge aluminum alloy product is then cold rolled to a second intermediate gauge, ranging between 0.090 inches and 0.150 inches, followed by an intermediate anneal at a predetermined time and temperature. The intermediate gauge annealed product is then cold rolled to final gauge. Preferred times and temperatures for the intermediate gauge anneal include 600° F. to 900° F. for up to 12 hours.

As discussed above, prior art processing techniques, wherein the hot rolled material exits the hot mill at a typical minimum temperature of 650° F. and is directly cold rolled to final gauge, result in materials subject to ridging or roping lines in the final product. It is believed that the source of these ridging lines is related to a textural banding in the product. That is, the ridging lines consist of a band of grains having a similar orientation, specifically, a (100)<001> crystallographic texture. Although the origin of these bands of grains is not clearly understood, it is believed that the bands of similar orientation act like a large single grain during deformation. Specifically, the individual grains in the separated bands experience similar grain rotations at the free surface, comparable to the mechanism causing the appearance of "orange peel" after straining sheet metal with large grains. These bands of grains, that have similar rotations at the free surface, are visible on the strained sheet as lines or ridges, thereby producing unattractive and detrimental surface relief.

To overcome this problem, the inventive method utilizes a lower exit temperature at the hot rolling stage than prior art processes. Lower hot working temperatures in the final passes of the hot mill result in increased amount of solute precipitation, a retention of a wrought structure, and greater potential for uniform spacial arrangement of grain orientation in the structure upon subsequent annealing. The warm worked structure can then be used to promote the nucleation and growth of grains with a more random distribution of orientations during a subsequent annealing step, thus preventing the formation of textural bands.

By lowering the temperature and performing sufficient reduction of the intermediate product exiting the hot rolling step, it is believed that the aluminum material is unable to recover sufficiently from the rolling deformation, thereby providing a structure having an increased number of nucleation sites, as well as stored energy, for recrystallization of grains with different orientations. The lower exit temperature in the hot rolling step is also believed to contribute to the precipitation of particles in the material, such as magnesium silicide compounds in AA6111, these precipitate particles offering additional sites for nucleation of randomly oriented grains. The formation of numerous and randomly oriented grains effectively interrupts the creation of bands of similarly oriented grains which are believed to contribute to the ridging line defect. Since the similarly oriented bands of grains do not form, they cannot buckle uniformly upon straining to develop surface relief.

For the intermediate anneal shown in FIG. 2, the annealing temperature should be sufficiently high and for a sufficient length of time to promote the necessary recrystallization described above, while avoiding excessive surface oxidation or excessive grain growth, which may result in increased susceptibility of the final product to develop "orange peel" upon straining. As will be described below, the annealing practices used with the products processed in accordance with the invention, as demonstrated by the examples, did not generate oxide or orange peel problems.

Preferably, the annealing temperature range for hot rolled sheet ranging in gauges from 0.130 inches to 0.150 inches, with 0% subsequent cold work, is 750° F. to 800° F. for about two hours. Preferred temperatures and times for annealing of sheet that experienced 45% to 70% cold work following hot rolling, range between 650° F. and 700° F. for approximately two to three hours.

Following the cold rolling to final gauge, typically between 0.016" and 0.065" ideally about 0.040" the aluminum sheet is solution heat treated, leveled and formed or stamped to provide its desired end use configuration.

The solution heat treatment should he the conventional treatment for the alloy which results in solutionizing of the strengthening phase. For example, a AA6111 aluminum alloy product when subjected to the inventive processing is subsequently given a solution heat treatment, quenched, and naturally aged.

The forming step can be any conventional type such as stamping wherein the final gauge aluminum alloy sheet is formed to a desired configuration.

The homogenized ingots were then hot rolled following the sequence: ingot breakdown reversing mill—intermediate reversing mill—five stand tandem mill. The hot line lay-on temperature ranged between 901° F. and 972° F.

Table I shows the entry temperature and mill speed for the tandem finishing mill for each of the lots. Entry temperatures ranged between 741° F. and 905° F. with the exit temperature ranging between 560° F. and 727° F. The exit temperature was varied by letting the slabs cool on the roller table and/or adjusting the speed of the tandem finishing mill.

The exit gauge of the hot rolled sheet was varied between 0.13, 0.18 and 0.25". At gauges of 0.130" and 0.180", the hot line product was either rolled directly to final gauge or given an anneal prior to any cold work and then cold rolled to final gauge. The 0.250" gauge hot line product was given a cold reduction of 48%, annealed, and then cold rolled to final gauge.

TABLE I

| | Process Conditions | | | | | | |
|---|---|---|---|---|---|---|---|
| Lot No. | Break-Down Mill Lay-On Temp. [°F.] | Tandem Mill Entry Temp. [°F.] | Tandem Mill Mill Speed [feet/min.] | Tandem Mill Exit Temp. [°F.] | Tandem Mill Exit Gauge [in.] | Percentage of Cold Work Before Annealing | Ridging Line Susceptibility |
| 1 | 972 | 905 | 800 | 727 | 0.18 | N/A | yes |
| 2 | 971 | 880 | 825 | 710 | 0.18 | 0% | yes |
| 3 | 969 | 880 | 850 | 677 | 0.13 | N/A | yes |
| 4 | 978 | 881 | 850 | 674 | 0.13 | 0% | yes |
| 5 | 965 | 877 | 800 | 656 | 0.13 | N/A | yes |
| 6 | 970 | 851 | 750 | 636 | 0.13 | N/A | yes |
| 7 | 972 | 870 | 750 | 634 | 0.13 | N/A | yes |
| 8 | 958 | 847 | 750 | 677 | 0.18 | N/A | yes |
| 9 | 957 | 826 | 675 | 652 | 0.18 | N/A | yes |
| 10 | 945 | 801 | 600 | 623 | 0.18 | 0% | yes |
| 11 | 935 | 806 | 550 | 609 | 0.18 | N/A | yes |
| 12 | 944 | 801 | 550 | 600 | 0.18 | N/A | yes |
| 13 | 920 | 741 | 500 | 591 | 0.25 | 48% | no |
| 14 | 922 | 790 | 740 | 596 | 0.13 | N/A | yes |
| 15 | 901 | 763 | 760 | 560 | 0.13 | 0% | no |

In order to demonstrate the elimination of ridging line defects in the final gauge aluminum sheet product, the following experiments were conducted. It should be understood that reference to percentages of alloy elements is in weight percent unless otherwise noted. In addition, the experiments are intended to be representative of the inventive method and product and are not to be considered as limiting the invention.

With reference to Table I and Table II, 15 lots and 3 lots, respectively,of AA6111 were cast, homogenized and hot rolled to investigate the appearance or absence of paint brush lines in the final gauge product.

The alloy composition ranges of the lots were cast to AA6111 specifications, as follows (in weight percent): Si 0.60– 1.1, Fe 0.40 max., Cu 0.50–0.9, Mn 0.10–0.45, Mg 0.5–1.0, Cr 0.10 max., and Zn 0.15 max.

The aluminum alloy lots were cast into ingots, scalped and homogenized for 34 hours between 1,000° F. and 1,050° F.

As can be seen from Table I, Lot Nos. 2, 4, 10 and were given an anneal prior to any cold rolling with Lot No. 13 receiving an anneal after a 48% cold reduction, which corresponds to 57% of the total reduction.

Table I also shows that each of the lot numbers, except Nos. 13 and 15, exhibited ridging line susceptibility as will be further described.

Typical reductions in the hot rolling step for stands 1–5 were 51%, 25%, 13%, 7% and 4% of the total reduction. This provides reductions at each stand of 46%, 42%, 37%, 31% and 25% for 0.180" hot line gauge; 47%, 38%, 32%, 26% and 20% for 0.250" exit gauge; and 47%, 44%, 41%, 37% and 34% for 0.130" exit gauge.

The coils given the hot line anneal were heated for about 2½% hours at between 750° and 800° F. followed by furnace cooling to 450° F. and air cooling to room temperature. Except for Lot No. 13, each of the lots was cold rolled to final gauge of 0.041" using conventional cold rolling techniques.

Lot 13 was cold rolled to 0.130" given an intermediate anneal for two hours between 650° F. and 700° F. and then cold rolled to final gauge.

Each lot number was then given a conventional solution heat treatment and quench for AA6111 alloys.

Each of the lot numbers was then investigated for ridging line susceptibility. In this evaluation, two ridging line tests were used for evaluation purposes. A first test involved buffing a one-inch wide strip, straining this strip 2% in the LT direction and observing the severity of the ridging lines formed on the strip surface optically. A second test comprised forming pans of the aluminum alloy sheet product that are typically used for evaluating dent resistance and observing the severity of ridging line formation in the strained regions of the pans.

As is evident from Table I, each of the lots except Nos. 13 and 15 exhibited ridging line susceptibility.

In an alternative ridging line evaluation, Lot Nos. 1 and 15 were used to form automotive car hoods. The car hoods formed from Lot No. 15 did not exhibit ridging lines whereas hoods formed from Lot No. 1, produced using prior art processing, did exhibit ridging lines.

The results summarized in Table I indicate that ridging lines can be eliminated by maintaining a lower exit temperature coming off the hot rolling mill followed by a subsequent anneal, after the hot rolled material or intermediate product is subjected to a 0% cold reduction at hot roll exit gauges less than or equal to 0.15" or a 48% cold reduction for thicker gauges.

To confirm the finding demonstrated in Table 1, three additional lots, see Table II, were cast, homogenized and hot rolled according to the inventive method.

size of ~6.5). This small grain size was well within the acceptable grain size range for this sheet product. Thus, the hot line anneal for Lot No. 15 did not produce an unacceptably large grain size which could result in orange peel during component formation.

Likewise, the oxide thickness and oxide chemistry were investigated for this lot. It was found that the oxide levels of the hot line annealed material were acceptable, and the chemistry was unchanged from prior practice. Thus, the inventive method should not form unacceptable levels of surface oxide in the final product.

Although a final gauge product of 0.040" was exemplified in the experiments discussed above, it is contemplated that the inventive processing can be utilized to produce aluminum sheet product in final gauge thicknesses ranging between 0.015 to 0.065".

As such, an invention has been disclosed in terms of preferred embodiments thereof which fulfill each and every one of the objects of the present invention and provide an improved method for making aluminum alloy sheet products and sheet products therefrom.

Of course, various changes, modifications and alterations from the teachings of the present invention may be contemplated by those skilled in the art without departing from the intended spirit and scope thereof. For instance, cold rolling has been described as an example of a cold working technique for reducing the thickness of the intermediate product. Other well known cold working techniques, such as stretching and forging, also could be used. Accordingly, it is intended that the present invention only be limited by the terms of the appended claims.

TABLE II

| | Process Conditions | | | | | | |
|---|---|---|---|---|---|---|---|
| Lot No. | Break-Down Mill Lay-On Temp. [°F.] | Tandem Mill Entry Temp. [°F.] | Tandem Mill Mill Speed [feet/min.] | Tandem Mill Exit Temp. [°F.] | Tandem Mill Exit Gauge [in.] | Percentage of Cold Work Before Annealing | Ridging Line Susceptibility |
| 16 | 914 | 748 | 750 | 514 | 0.130 | 0% | No |
| 17 | 910 | 743 | 730 | 569 | 0.130 | 0% | No |
| 18 | 901 | 750 | 680 | 550 | 0.150 | 0% | No |

As can be seen from Table II, the exit temperatures of Lot Nos. 16–18 were controlled to be less than 600° F. and the exit gauge was 0.15" or less. Each of Lots 16–18, following hot rolling, was given a two-hour anneal between 750° and 800° F., prior to any cold reduction. The annealed material was then cold rolled to a gauge of about 0.040" and given a standard solution heat treatment and quench. Although none of Lots 16–18 exhibited severe ridging lines, the 0.130" hot roll exit gauge had slightly superior surface appearance than the 0.150" sheet product.

The findings of Table II confirm that the lower hot rolling exit temperature in conjunction with a subsequent annealing step eliminates or minimizes ridging line susceptibility in these types of aluminum alloy sheet products.

When using an anneal in the inventive process, the potential for unacceptable defects, such as orange peel or surface oxide on the sheet product, could occur. With reference again to Table I, the grain size of Lot No. 15 was investigated. Lot No. 15, which also exhibited superior surface appearance, exhibited an average grain diameter of between 30 μm and 40 μm (corresponding to an ASTM grain

What is claimed is:

1. In a method of producing an aluminum alloy sheet product comprising casting an aluminum alloy to provide a slab, homogenizing the slab, hot rolling the slab to provide an intermediate gauge product, cold rolling the intermediate gauge product to a final gauge product, and solution heat treating the final gauge product to provide an aluminum alloy sheet product, the improvement comprising:

controlling hot rolling of the slab so that the temperature of the intermediate gauge product exiting the hot rolling step is between about 500° F. and 600° F.; and either (a) annealing said intermediate gauge product between 700° F. and 900° F. for up to 18 hours and cold rolling said annealed intermediate gauge product to a final gauge product; or (b) cold rolling said intermediate gauge product to provide a second intermediate gauge product, annealing said second intermediate gauge product between 600° and 900° F. for up to 12 hours, and cold rolling said annealed second intermediate gauge product to a final gauge product;

wherein said aluminum alloy sheet product is substantially free from bands of grains having a similar crystallographic orientation so that said sheet product can be subsequently strained without substantial formation of ridging lines on a surface of said sheet product.

2. The method of claim 1 wherein said intermediate gauge product is annealed between about 750° F. and 800° F. and cold rolled to the final gauge product.

3. The method of claim 1 wherein said second intermediate gauge product is annealed between about 650° F. and 700° F. and cold rolled to the final gauge product.

4. The method of claim 1 wherein said temperature of the intermediate gauge product is controlled between 550° and 600° F.

5. The method of claim 1 wherein said temperature of the intermediate gauge product is controlled between 500° and 575° F.

6. The method of claim 2 wherein said intermediate gauge product has a gauge ranging between 0.130 and 0.180 inches.

7. The method of claim 3 wherein said intermediate gauge product has a gauge ranging between 0.180 and 0.300 inches and said second intermediate gauge ranges between 0.090 and 0.180 inches.

8. The method of claim 1 wherein said aluminum alloy is a AA6000 series or an AA2000 series alloy.

9. The method of claim 1 wherein said aluminum alloy is a AA6111 alloy.

10. The method of claim 1, further comprising the step of forming said aluminum alloy sheet product into an automotive body component.

11. The method of claim 1 wherein the gauge of said final gauge product is about 0.040 inches.

12. A product made by the method of claim 1.

13. A product made by the method of claim 10.

14. A product made by the method of claim 2.

15. A product made by the method of claim 3.

16. The product of claim 13 wherein said automotive body component is a deck lid or a hood.

17. In a method of producing an aluminum alloy sheet product comprising casting an aluminum alloy to provide a slab, homogenizing the slab, hot rolling the slab to provide an intermediate gauge product, cold rolling the intermediate gauge product to a final gauge product, and solution heat treating the final gauge product to provide an aluminum alloy sheet product, the improvement comprising:

controlling hot rolling of the slab so that the temperature of the intermediate gauge product exiting the hot rolling step does not exceed 575° F.; and either (a) annealing said intermediate gauge product between 700° F. and 900° F. for up to 18 hours and cold rolling said annealed intermediate gauge product to a final gauge product; or (b) cold rolling said intermediate gauge product to provide a second intermediate gauge sheet product, annealing said second intermediate gauge product between 600° and 1000° F. for up to 12 hours, and cold rolling said annealed second intermediate gauge product to a final gauge product;

wherein said aluminum alloy sheet product is substantially free from bands of grains having a similar crystallographic orientation 80 that said sheet product can be subsequently strained without substantial formation of ridging lines on a surface of said sheet product.

18. A method of producing an aluminum alloy sheet product comprising:

casting an aluminum alloy to provide a slab, homogenizing the slab, hot rolling the slab to provide an intermediate gauge product, said hot rolling being controlled so that the temperature of the intermediate gauge product exiting the hot rolling does not exceed 575° F., cold working the intermediate gauge product to reduce its thickness between 0% and 70%, annealing the intermediate product after cold working, cold working the annealed product to provide a final gauge product, and solution heat treating and quenching the final gauge product to provide an aluminum alloy sheet product that is substantially free from bands of grains having a similar cystallographic orientation so that said sheet product can be subsequently strained without substantial formation of ridging lines on a surface of said sheet product.

* * * * *